US007600462B2

(12) United States Patent
Quinn

(10) Patent No.: US 7,600,462 B2
(45) Date of Patent: Oct. 13, 2009

(54) DUAL ELEVATION WEAPON STATION AND METHOD OF USE

(75) Inventor: James P. Quinn, Gurnee, IL (US)

(73) Assignee: Recon/Optical, Inc., Barrington, IL (US)

( * ) Notice: Subject to any disclaimer, the term of this patent is extended or adjusted under 35 U.S.C. 154(b) by 0 days.

(21) Appl. No.: 11/800,177

(22) Filed: May 3, 2007

(65) Prior Publication Data

US 2008/0048033 A1 Feb. 28, 2008

Related U.S. Application Data

(60) Division of application No. 10/894,321, filed on Jul. 19, 2004, now Pat. No. 7,231,862, which is a continuation of application No. 10/304,230, filed on Nov. 26, 2002, now Pat. No. 6,769,347.

(51) Int. Cl.
*F41G 5/12* (2006.01)
*F41G 5/08* (2006.01)

(52) U.S. Cl. ..... 89/41.08; 89/41.07; 89/41.15; 89/41.09; 89/204; 89/205

(58) Field of Classification Search ..... 89/41.05, 89/41.07, 41.08, 41.14, 41.15, 204, 205, 89/206, 41.09
See application file for complete search history.

(56) References Cited

U.S. PATENT DOCUMENTS

| | | | | |
|---|---|---|---|---|
| 1,445,028 A | | 2/1923 | Morse | 89/204 |
| 1,612,118 A | | 12/1926 | Hewlett et al. | 89/41.19 |
| 2,065,303 A | | 12/1936 | Chafee et al. | 235/405 |
| 2,206,875 A | | 7/1940 | Chafee et al. | 89/204 |
| 2,504,118 A | * | 4/1950 | Evans | 89/41.08 |
| 2,715,776 A | * | 8/1955 | Knowles et al. | 89/202 |
| 3,618,456 A | | 11/1971 | Mindel | 89/134 |
| 3,766,826 A | | 10/1973 | Salomonsson | 89/41.17 |
| 4,004,729 A | * | 1/1977 | Rawicz et al. | 235/404 |

(Continued)

FOREIGN PATENT DOCUMENTS

| | | |
|---|---|---|
| EP | 0411993 | 7/1990 |

(Continued)

OTHER PUBLICATIONS

Published International Search Report for PCT application of Recon/Optical, PCT/US03/37285, dated Jun. 3, 2004, 7 pages.

*Primary Examiner*—Stephen M Johnson
(74) *Attorney, Agent, or Firm*—McDonnell Boehnen Hulbert & Berghoff LLP

(57) ABSTRACT

A gimbaled weapon system (GWS) implements methods for identifying and tracking a target. In one aspect, the sighting system of the GWS moves independently in elevation from the weapon cradle and tracks a target while the weapon cradle and attached weapon are maintained in a non-hostile position, such as a stowed or vertical position. In another aspect, the method uses a system of networked sensors in communication with an observation unit for the GWS. The sighting system is elevated using a second elevation drive to acquire a target based on signals received the system of networked sensors. The network sensors provide coordinates of probable targets, which can trigger automatic tracking of the target or an alarm to notify the operator of a probable target.

9 Claims, 7 Drawing Sheets

U.S. PATENT DOCUMENTS

| | | | | | |
|---|---|---|---|---|---|
| 4,112,818 | A | | 9/1978 | Garehime, Jr. | 89/134 |
| 4,164,165 | A | | 8/1979 | Bean et al. | 89/134 |
| 4,273,026 | A | | 6/1981 | Walter | 89/37.01 |
| 4,317,304 | A | | 3/1982 | Bass | 42/125 |
| 4,386,848 | A | | 6/1983 | Clendenin et al. | 356/5.01 |
| 4,528,891 | A | | 7/1985 | Brunello et al. | 89/41.21 |
| 4,579,035 | A | * | 4/1986 | Whiting | 89/41.05 |
| 4,760,770 | A | | 8/1988 | Bagnall-Wild et al. | 435/7.5 |
| 4,970,938 | A | | 11/1990 | Allais et al. | 89/41.19 |
| 5,056,409 | A | | 10/1991 | Allais et al. | 89/37.01 |
| 5,129,309 | A | | 7/1992 | Lecuyer | 89/41.06 |
| 5,171,933 | A | | 12/1992 | Eldering | 89/41.06 |
| 5,247,867 | A | * | 9/1993 | Corney | 89/8 |
| 5,408,778 | A | | 4/1995 | Goodwin et al. | 42/137 |
| 5,456,157 | A | | 10/1995 | Lougheed et al. | 89/134 |
| 5,474,255 | A | * | 12/1995 | Levita | 244/3.14 |
| 5,686,690 | A | * | 11/1997 | Lougheed et al. | 89/41.17 |
| 5,949,015 | A | | 9/1999 | Smith et al. | 89/41.05 |
| 6,123,006 | A | | 9/2000 | Bedford, Jr. et al. | 89/41.06 |
| 6,769,347 | B1 | | 8/2004 | Quinn | 89/41.05 |
| 7,210,392 | B2 | | 5/2007 | Greene et al. | 89/41.03 |
| 7,231,863 | B2 | | 6/2007 | Quinn | 89/41.05 |

FOREIGN PATENT DOCUMENTS

| | | | |
|---|---|---|---|
| EP | 0844456 | | 9/2000 |
| GB | 633866 | | 4/1950 |
| GB | 2 077 400 A | * | 12/1981 |
| WO | WO 8200515 | | 2/1982 |

* cited by examiner

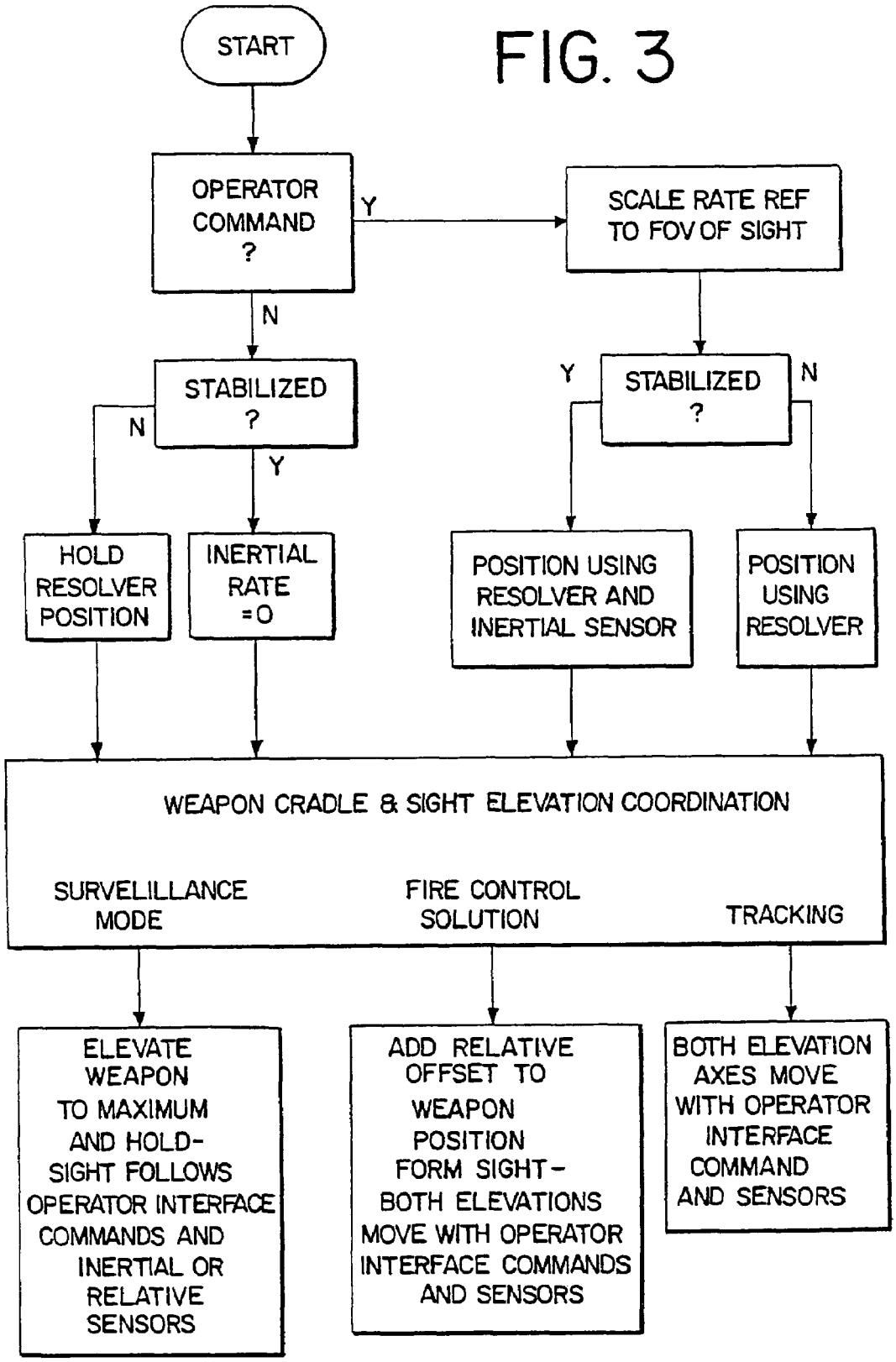
FIG. 3
START
OPERATOR COMMAND ?
Y
SCALE RATE REF TO FOV OF SIGHT
N
STABILIZED ?
N
Y
STABILIZED ?
Y
N
HOLD RESOLVER POSITION
INERTIAL RATE =0
POSITION USING RESOLVER AND INERTIAL SENSOR
POSITION USING RESOLVER
WEAPON CRADLE & SIGHT ELEVATION COORDINATION
SURVELILLANCE MODE
FIRE CONTROL SOLUTION
TRACKING
ELEVATE WEAPON TO MAXIMUM AND HOLD- SIGHT FOLLOWS OPERATOR INTERFACE COMMANDS AND INERTIAL OR RELATIVE SENSORS
ADD RELATIVE OFFSET TO WEAPON POSITION FORM SIGHT- BOTH ELEVATIONS MOVE WITH OPERATOR INTERFACE COMMANDS AND SENSORS
BOTH ELEVATION AXES MOVE WITH OPERATOR INTERFACE COMMAND AND SENSORS

DUAL ELEVATION WEAPON STATION AND METHOD OF USE

RELATED APPLICATIONS

This application is a divisional of Ser. No. 10/894,321, filed on Jul. 19, 2004, now U.S. Pat. No. 7,231,862; which is a continuation in part of Ser. No. 10/304,230, filed on Nov. 26, 2002, now U.S. Pat. No. 6,769,347.

BACKGROUND OF THE INVENTION

1. Field of Invention

My invention relates generally to gimbaled weapon stations (GWS) that provide sighting, fire control and a weapon cradle in a self-contained system and to methods for using a GWS. In particular, the gimbaled weapon station of my invention allows a weapon cradle and a sighting system to move together in azimuth, but each can be elevated completely independently of each other. This allows for continuous target tracking and sighting regardless of the super-elevation needed for the weapon to achieve the correct ballistic trajectory. My weapon station can also be stabilized and operated remotely.

2. Description of the Prior Art

Target tracking and weapon control systems are known. For example, on ships, a single weapon sight that can move in both azimuth and elevation can control and direct fire of several large weapons. These large weapons can also move in both azimuth and elevation in response to signals received from a fire control computer, which receives input from the separately controlled weapon sight. For smaller weapons, such as machine guns, it is known to combine the weapon sight and cradle on a single platform typically with the sight mounted directly on the weapon or the weapon cradle, but in either case there is only a single elevation axis. One such small weapon control system is disclosed in U.S. Pat. No. 5,949,015, which provides for a weapon mount and sighting system on a single gimbaled mount. The system can be operated by remote control and includes gyro stabilization. Such systems, however, suffer from the drawback that both the gun sight and the weapon share a common elevation mechanism. In other words, as the operator moves the gun sight to track a target in either azimuth or elevation the weapon must necessarily follow. Accordingly, if the operator raises the gun sight in elevation to track the target the weapon will also raise in elevation because there is only a single elevation mechanism to raise both the sight and the weapon. In these prior art systems, it is typical that the gun point and the aiming system (gun sight combined with basic fire control) are directed at the same target coordinates. Various sensors are typically used for the aiming systems; for example, visible and infrared imaging devices to view the target and a laser range finder to determine distance to the target. However, in situations referred to as super-elevation, where the weapon must be elevated to a greater angle than the target line of sight in order to launch the projectile to the hit the target over a long distance, the sighting or aiming system no longer views the target since the aim point of the gun no longer includes the target in the field of view.

In situations where a fire control computer can correct for ballistic trajectory (i.e., it can automatically raise the weapon to a super-elevation position to ensure the projectile impacts the target) a serious problem arises when there is only one elevation axis. When the fire control computer super-elevates the weapon, the sight must also increase in equal elevation. This causes the user to completely lose view of the target in the sight. If the user tries to override the fire control computer and lower the sight to regain view of the target the weapon will also be lowered causing a fired projectile to fall short of the designated target.

The art has recognized this serious problem and has attempted to provide a solution. For example, some weapon systems provide an offset mechanism. One such mechanism counter rotates the gun sight from the gun by an amount needed to bring the target back into the field of view of the sight. The disadvantage of this system is that it can introduce errors in the aiming accuracy because of the added complexity and mass of the additional counter rotation system components, which are placed on the single weapon elevation axis. This added complexity and mass must be added to the sole elevation mechanism, which greatly increases the chances for error in aiming the gun during super elevation. Another disadvantage is that counter rotation has a very limited range of movement and it can also introduce target image blur as the offset between the gun and sight is being established. Prior art systems can have offset mechanisms that cause either small mechanical elevation changes of the gun, the sight, or cause an electronic repositioning of the sight reticle in the sight display. U.S. Pat. Nos. 5,456,157, 5,171,933, and 4,760,770 each disclose variations in the type of offset mechanism utilized by the weapon system. For example, in the '933 patent the gun is offset by several servo motors to achieve super-elevation once target acquisition is acquired by the user. In the '157 patent a computer generated offset of the sight reticle is used to correct the gun aim point for super-elevation targeting requirements. In each of these known offset systems, however, the amount of offset possible is very limited, which of course drastically limits target range capability. A need therefore exists to provide a gimbaled weapon system (GWS) that avoids these problems and that allows mechanical elevation of the sighting system independent of weapon elevation, while allowing the weapon to achieve a super-elevation position to ensure target hit accuracy.

Accordingly, one object of my invention is to provide a self contained GWS that has two separate elevation means, one for a sighting system and one for a weapon cradle, where the cradle can hold a variety of different weapons. This system provides for totally independent elevation axes and associated control and drive mechanisms.

Another object of my invention is to provide a GWS that eliminates the need for an offset mechanism when super-elevation is needed for correct ballistic trajectory. This is accomplished by providing full elevation axes for both the weapon cradle and sighting system.

A further object is to provide a GWS where the dual elevation axes are stabilized independently or in common. Stabilization is very beneficial when large mass weapons are used with my GWS or when the GWS is used on a moving platform, such as a tank, troop carrier or other wheeled vehicle or boat deck.

Yet another object of my invention is to provide a control algorithm to coordinate the movement of the two independent elevation axes so that the user can continuously view and track a target without interruption and which will allow the weapon cradle (and the installed weapon) to achieve a correct super-elevation position independent of the actual elevation of the sighting system.

Other objects will be recognized upon reading the following disclosure in conjunction with the accompanying figures.

SUMMARY OF THE INVENTION

My invention is directed to a gimbaled weapon system (GWS) that combines a weapon cradle and a sighting system in a self-contained unit that is capable of 360° rotation in azimuth. The sighting system of my invention includes the actual sighting device or mechanism itself, including the associated optics and electronics, and also may include a line of sight (LOS) reflector that transmits or reflects images to the sighting device. My GWS is capable of either manual or remote control operation and also provides independent elevation axes for both the weapon cradle and the sighting system. Separate elevation axes allow the weapon operator to always maintain visual contact with the target through the sighting device even during a super-elevated condition of the weapon. Coordination between the two separate elevation axes is accomplished using a control unit containing one or more software algorithms that analyzes and controls the relative position of each elevation axis based on inputs received from GWS subsystems including position sensors on each axis, fire control processor, operator display commands, sighting system, stabilization system or from other systems, such as a host vehicle. The fire control processor monitors and processes range data, platform cant, ammunition and weapon type, ambient pressure and temperature, and bore sight information. The sighting system provides an image of the target using visible and or infrared video cameras and range data through the operation of an active device, such as a laser range finder or through the use of a passive device. Preferably the laser range finder is optional eye safe Class 1, which provides range measurement accurate to +/−10 meters for engagement of vehicle sized land, maritime and aerial targets at ranges up to 5000 meters. My GWS can also provide the capability for the weapon operator to zero the installed weapon at selected ranges. Zeroing consists of adjusting the bore-sighted reticle position (aim point) based on the results of weapon firing. Zeroing controls provide for reticle movement in increments of less than 0.1 mil in azimuth and elevation. Bore sighting in my invention can be accomplished without exposing the operator to the outside environment, and more importantly to hostile fire, by the use of a remote sensor that is aligned with the bore of the particular weapon mount on the GWS. This remote sensor transmits a target image to the operator for comparison with the target image captured by the sighting system. The sighting system is electronically adjusted, typically by electronic manipulation of the target reticle, so that the two target images coincide.

The GWS includes a smart system that can sense the specific type of weapon installed in the cradle. This information, along with the identification of ammunition type, and other data that can be entered through the use of a touch screen video display physically located away from the GWS, is sent to the fire control processor. Of course, depending on the weapon mounted the ammunition will automatically be known and selected by the smart system. For those weapons that are capable of firing different ammunition, then input of ammunition type is necessary. The fire control processor provides for accurate fire control of the weapon by using the information obtained from the smart system, range-to-target data, line of sight (LOS) indication, cant of the GWS platform, and ambient temperature and pressure, to calculate a fire control solution. In addition to providing super-elevation and azimuth displacement (projectile drift) signals, the fire control solution is used to re-orient the weapon and sight reticle in azimuth while allowing the operator to maintain visual contact with the target in a high magnification-viewing field. However, in another mode of operation where the sighting system has independent elevation, the weapon is elevated and moved in azimuth to compensate for projectile drift and to develop target lead. Target lead is used to compensate for the relative motion between the target and weapon aimpoint. To keep the aimpoint on the target, the fire control solution is calculated using the tracking rates for azimuth and elevation that are generated by the gimbal. The commanded tracking rates come from the joystick or from a video-tracking device. Once the weapon and sight are moved in azimuth, the laser range finder is no longer pointed at the target preventing additional fire control solutions from being calculated. This condition is corrected by providing a small dynamic (+/−10 degree) azimuth adjustment to the sight. This small azimuth adjustment or correction is in the opposite direction of the target lead direction and can be accomplished using a second separate azimuth drive means that rotates just the sighting system +/−10 degrees. Alternatively, and more preferably, this second azimuth drive means moves an LOS reflector as opposed to the sighting device itself, because the LOS reflector is much less massive as compared to the sighting device. Because the second azimuth drive means is associated only with the sighting system it does not rotate or move the weapon cradle. The weapon aimpoint can then lead the target and the sight can still accurately point the laser ranger finder.

My invention can also be transformed from a remotely operated GWS to a manually operated system in the event platform system power is lost. Manual operation allows the weapon operator to traverse the GWS in azimuth, elevate the weapon mount, charge ammunition and fire the weapon. The GWS of my invention can be used on all forms of moving ground vehicles, helicopters, ships, boats and planes, and can accept a variety of weapons, including the Mk19 GMG (using 40 mm ammunition), M2 HMG (using 12.7 mm ammunition), M240 machine gun (using 7.62 mm ammunition), and M249 Squad Automatic Weapon using 12.7 mm ammunition. The GWS can move 360° in azimuth and be mounted in an existing hatch mounting pintle to allow for 360° manual rotation.

Accordingly, in one broad aspect, my invention is directed to a GWS, comprising a weapon cradle, at least one sighting system, an azimuth drive means for simultaneously moving the sighting system and weapon cradle in azimuth direction, a first elevation means for moving the weapon cradle in elevation, and a second elevation means for moving the sighting system in elevation, the second elevation means capable of operating independently of the first elevation means.

Alternatively, my invention is also directed to a gimbaled weapon station, comprising a weapon cradle, at least one sighting system, an azimuth drive means for simultaneously moving the sighting system and weapon cradle in azimuth direction, a first elevation means for moving the weapon cradle in elevation, a second elevation means for moving the sighting system in elevation, the second elevation means capable of operating independently of the first elevation means, a control algorithm means for coordinating movement of the first and second elevation means, a fire control processor capable of determining a fire control solution, and a stabilization system.

In addition, my invention includes a method of maintaining a weapon in a continuous offset position from a sighting system during operation of a GWS, whereby the sighting system is elevated using an elevation mechanism to acquire a target based on signals received from an observation unit located remotely from the GWS. An observation unit can be a combination of the operator interface and display, for example one that is located in the crew compartment remote from the actual weapon cradle and sighting system. Alternatively, an observation unit may comprise one or more target sensors that can detect a probable target without human observation, for example by using acoustic sensors, radar, infrared detection, or a combination of these sensors, or any other type of sensor known to the art. The target sensors could be portable and positioned locally or remotely from the GWS to monitor and provide a wide range of coverage. In addition, target determination may be accomplished using a network of sensors. These sensors may be hosted by satellites, manned aircraft, unmanned air vehicles (UAV), ground vehicles, and may include other GWS systems, remote human observation, or a combination of such sensor systems, where the coordinates or location of the target is sent to the GWS control unit over a wired or wireless network, such as the Internet, an intranet, or WiFi. Upon receipt of the target information from the sensors, the GWS is cued and the sighting system commanded to point at the target location or coordinates for observation in preparation for target engagement Alternatively, the target sensors, after detecting a probable target, would interface with the control unit of the GWS, typically by transmitting electrical signals or radio waves. The control unit would then begin tracking the target automatically by controlling the azimuth and elevation means, compute a fire control solution and engage the target, all without human intervention. Alternatively, the control unit could activate an alarm to notify the GWS operator of a probable target. Upon receiving indication of a probable target the operator could take active control of the sighting system using the operator interface to track, range and engage the target. It desirable to have the control unit automatically adjust the azimuth and elevation of the sighting system so that when the operator is notified of a probable target the sighting system will be positioned to observe the target when the operator consults the display. Likewise, it is desirable to have the weapon cradle also moved to a predetermined aim point based on the probable target's location. The elevation of the sighting system is determined or sensed using a first position sensor that is in communication with the control unit. The position of the weapon cradle is determined using a second position sensor, which is likewise in communication with the control unit. The control unit calculates a predetermined offset elevation for the weapon cradle based on the elevation of the sighting system. The elevation of the weapon cradle and installed weapon is changed using a completely different and independent elevation mechanism to achieve the predetermined offset elevation calculated by the control unit. These steps are repeated for each new elevation of the sighting system.

In some tactical situations during target observation it is desirable not to have the mounted weapon pointed at or near the target, for example, in crowd control situations a pointed weapon may cause panic or insight undesirable behavior. Accordingly, my invention may contain an optional feature whereby the operator or the commander can execute an algorithm in the control unit whereby the gun mount does not track with the sighting system. Preferably, this algorithm upon execution will place the weapon cradle and mounted weapon in a non-hostile position, for example in a stowed position or a position where the weapon's bore, or aimpoint, is not in a line of sight with a target being observed by the sighting system.

My invention may also include a means to record target engagement, whether that engagement is merely observation by the sighting system or by both the sighting system and actual weapon fire. In either case, the recording means will allow playback of the target engagement at a future time for evaluation and analysis. The image received and observed by the sighting system, including both visual and thermal, is recorded by any number of available and well-known recording systems and media. In one possible embodiment a continuous loop of recording provides a foolproof means to capture a particular target engagement action.

Another optional feature of my invention is commander override. This allows the commander of the GWS weapon or its location, or other person having authority, over the GWS to execute an algorithm in the control unit that prevents the operator of the GWS from firing the mounted weapon. A preferred commander override system includes a separate observation unit or commander monitor that allows the commander to observe the same images being observed by the operator. If the commander makes a decision not to engage a particular target being observed, he or she can execute an algorithm that disables the operator's ability to fire upon the observed target. Along the lines of the commander override feature is the establishment or creation of no fire zones by either the operator or the commander. A no fire zone is a predetermined set of coordinates, typically in azimuth, whereby weapon fire is purposely disabled for a period of time corresponding to the predetermined no fire zone. For example, during observation using the sighting system the operator can select a beginning or starting point of the no fire zone and the azimuth coordinates for the beginning of the zone are stored in the control unit memory using a no fire zone algorithm. The sighting system is further used to select or determine the coordinates for the end point of the no fire zone, which are likewise retained in memory by the control unit. Multiple no fire zones can be placed into memory. When the no fire zone option is engaged, traversing or slewing the GWS in azimuth between the starting and ending coordinates of the no fire zone the control unit will prevent weapon fire in that predetermined zone or zones. This option finds utility in situations where certain structures, such as equipment (i.e., an antenna, hatch, etc.) or historical building, happens to be within the LOS of sighting system and as such could receive weapon fire whether intentionally targeted or not. Once the GWS is slewed out of the no fire zone the control unit will again allow weapon firing.

Another method of my invention relates to positioning a weapon during operation of a GWS based on target acquisition obtained from a sighting system where the sighting system is elevated with an elevation mechanism to acquire a target based on signals received from an operator interface and display, or from one or more target sensors located remotely from the GWS. A target distance is determined using a range location device and the elevation of the weapon cradle is determined with a first position sensor. Next a fire control solution is calculated using a logic algorithm that receives as input at least the distance to target and the elevation of the weapon cradle. After the fire control solution is calculated the elevation of the weapon cradle and installed weapon is changed without changing the elevation of the sighting system.

BRIEF DESCRIPTION OF THE DRAWINGS

FIG. 3 is a detailed algorithm of the elevation control system of my invention.

DESCRIPTION OF PREFERRED EMBODIMENTS

Figure 1:
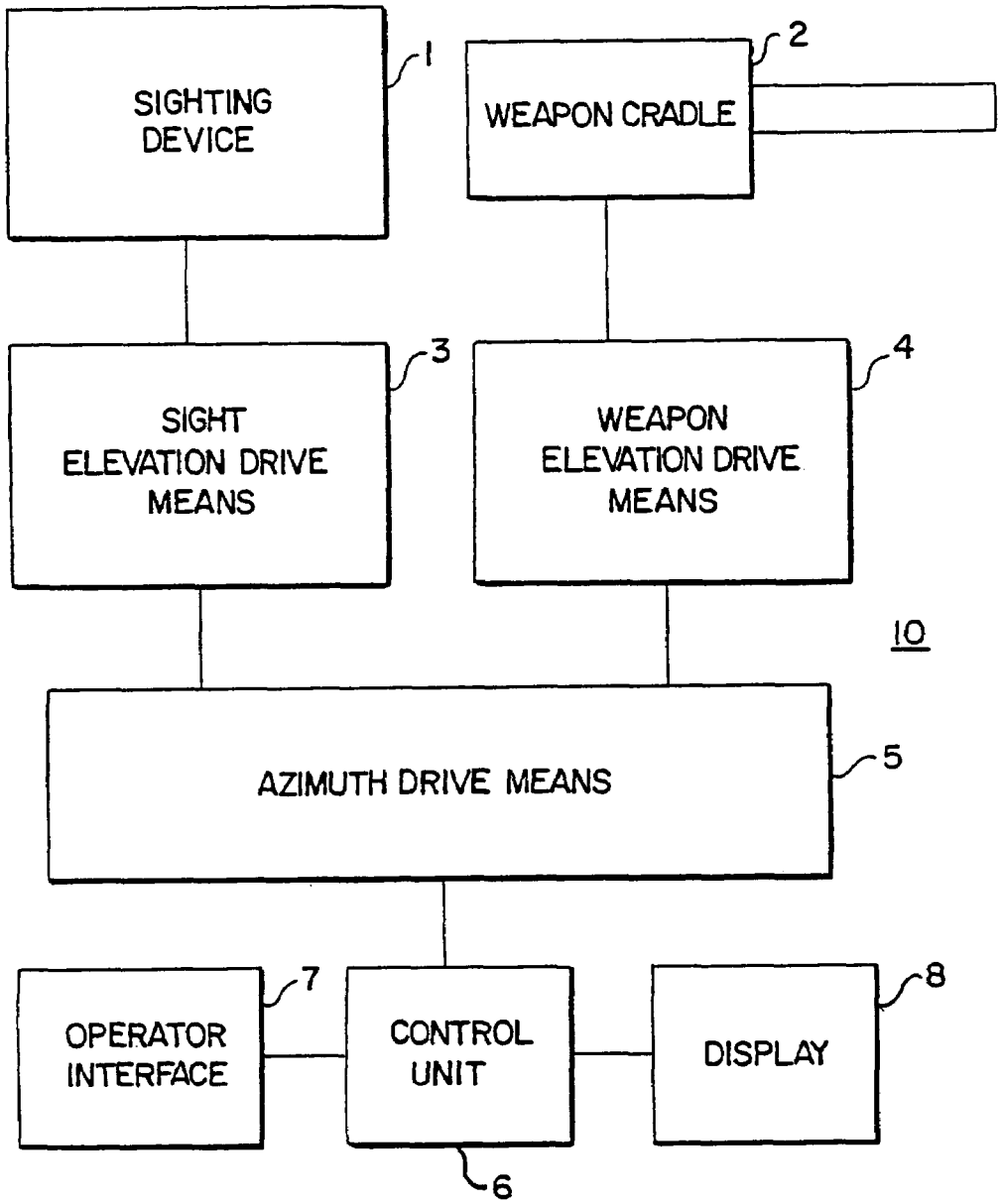
FIG. 1 is a schematic block diagram representing the GWS of my invention.

My invention is directed to a self-contained gimbaled weapon system (GWS) that has a sighting system and a weapon cradle where each has its own independent elevation axis. The GWS moves 360° in azimuth and allows the sighting system and weapon cradle to each move in elevation independently of each other, thereby allowing a weapon operator to always maintain visual contact with a target through the sighting system, yet allows the weapon cradle to achieve super-elevation positions to accommodate correct ballistic trajectories. FIG. 1 is a block diagram of my invention showing GWS 10 comprising sighting device 1 connected to a first sighting elevation means 3, which is detachably connected to azimuth drive means 5. Weapon cradle 2 is connected to a second elevation means 4, which, like first elevation means 3, is connected to azimuth drive means 5. Control of both elevation means 3 and 4 and azimuth drive means 5 is accomplished with control unit 6. Control unit 6 is connected to operator interface 7 and display 8, preferably with the interface and display located remotely from the control unit, azimuth drive means, the weapon cradle, sighting device, and the two elevation means. GWS command and control data can be entered through the operator interface 7 and display 8. In situations where the GWS is used on a vehicle platform, display 8 and interface 7 are located within the interior of the vehicle and all other components are located externally, preferably mounted to the roof of the vehicle.

Operator interface 7 is preferably any interface that an operator can use to provide control of the azimuth drive means and the sighting system elevation means, including an "X-box" type controller or joy stick device. Either is designed such that its operation is similar to what a user of a typical video game would experience. Display 8 receives information from control unit 6, such as video images, ranging data, weapon identification, ambient conditions, and other information needed by the weapon operator to acquire, track and fire on a target. The display is preferably a night and daylight readable active matrix liquid crystal display (LCD) having 800×600 pixels and is SVGA and RS-170 (NTSC)/CCIR (PAL) compatible. The display can also have an embedded text and graphic processor and can be fitted with a hood to further enhance the operator's view of the screen when exposed to bright sun light. The display also can provide a white and black reticle simultaneously, which is automatically viewable in all light conditions and all contrast/brightness levels of the display. Optionally, GWS can include a second observation unit having its own a separate display for the vehicle commander or other entity having operational control over the operation and firing of the GWS. This separate display is sometimes referred to as a commander monitor. This second observation unit can be in communication with the first observation unit or directly with the control unit or with both. Regardless of the communication connection, the second observation is capable of accepting instructions from the user to override a fire command from the first observation unit. Such a situation would occur if the commander or other authorized entity makes a decision that the target being observed by the first observation should not be fired upon or not continue to be engaged by the weapon mounted on the GWS.

Once a target is identified, a laser range finder as previously discussed and which is part of sighting device 1, is used to determine range to target. Alternatively, the weapon operator can manually input the range to target through interface 7 or display 8. This external range data can be determined directly by the operator or received from other external sources, for example, via radio communication or electronically from another GWS or similar weapons system. Azimuth drive means 5 rotates the entire GWS system giving the weapon operator a 360° field of view. The design of the azimuth drive means is not critical to my invention and any mechanism known to the art can be used.

Elevation means 3 and 4 are separate mechanical actuators comprising any known system of devices that can increase or decrease the elevation of sighting device I and weapon cradle 2. For example, the elevation means may comprise a motor and gear system or a direct motor drive system. A preferred elevation means is a motor and gear system, with the most preferred being a harmonic drive coupled to a servo motor. Likewise, it is within the scope of my invention that the elevation means could use a fluid driven actuator such as a hydraulic cylinder. Regardless of the specific system that is chosen, the elevation means should be capable of moving the weapon cradle and sighting system quickly and smoothly in response to operator commands. Most importantly, elevation means 3 must be a completely independent system from elevation means 4, thus allowing the weapon cradle to be elevated to a super-elevation position without affecting the elevation of sighting device 1. Likewise, sighting device 1 can be elevated without changing the elevation of weapon cradle 2. Position sensors (not shown) determine the elevation position of the weapon cradle and sighting device. Any type of position sensor known to the art will work with my invention. These position sensors provide elevation position information to the control unit, which in turn uses the information, along with other inputs, to compute a fire control solution.

The GWS of my invention can also contain a stabilization system or systems. Preferably, the GWS would contain at a minimum a stabilization system on the azimuth axis. Most preferably the GWS would also include sight elevation stabilization and/or weapon cradle elevation stabilization. Any type of known stabilization system can be used with my invention; however, a preferred stabilization system is one that uses fiber optic gyros. In the direct inertial rate stabilized approach the gyros move with the mechanical system to stabilize and a servo loop is used to regulate a null rate. Alternatively, the gyros can be mounted off-axis, where the gyros sense base motion and an elevation loop is commanded equal and opposite to the sensed based motion. When used on a moving vehicle and aiming at a stationary target, the GWS should provide weapon and sighting system stabilization sufficient to allow a gunner, moving over cross-country terrain to achieve at least one hit from a burst of fire against a vehicle-like stationary target located about 500 meters distant. This would apply to moving toward or away from a target. Likewise, when the target is moving it is preferred that the GWS can provide weapon and sighting system stabilization sufficient to allow a gunner in a vehicle, moving over cross-country terrain, less than about 3 mils, visual contact with a vehicle sized target up to about 1500 meters distant moving in the opposite direction over cross-country terrain.

Figure 2:
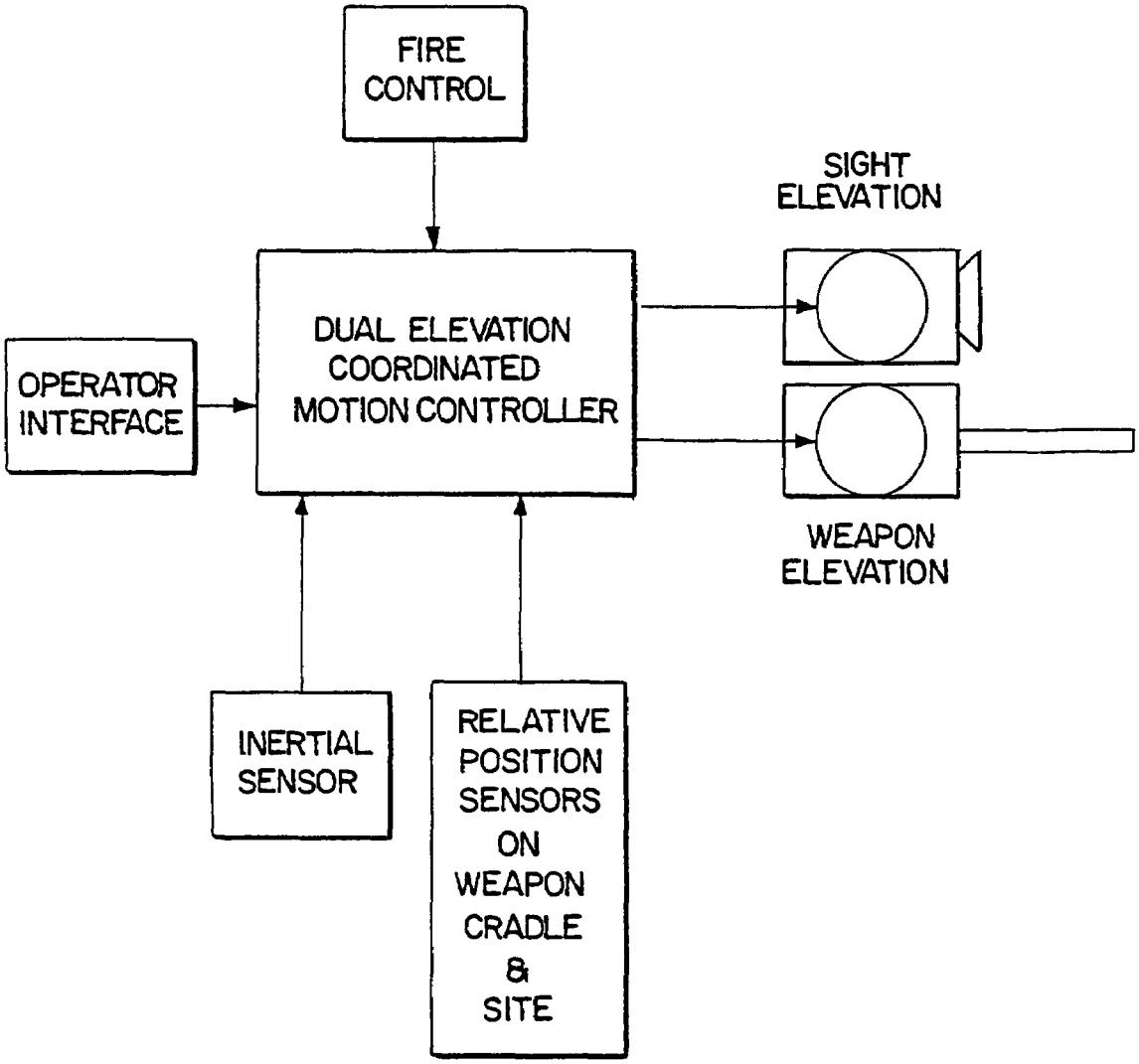
FIG. 2 is a schematic block diagram of elevation control system for coordinating the elevation axes of the weapon cradle and sighting device.

Power to drive the azimuth and elevation drive means is supplied by an external source and is not part of the GWS. For example, when the GWS is mounted to a vehicle, the GWS will use the host vehicle's power system. Control unit 6 contains a fire control processor which calculates and determines fire control solutions based on target range data, ambient temperature and air pressure, weapon type, ammunition type, platform cant and bore sight information. Control unit 6 also contains software, which executes a control algorithm that coordinates movement of the weapon cradle elevation means and sighting device elevation means. The control unit contains industry standard computer architecture with a state-of-the-art central processing unit (CPU). This computer architecture supports target tracking, coordination of the two elevation axes, fire control and other advanced sighting features including an infrared thermal imaging device, a visible imaging device, and a laser range finder. As schematically shown in FIG. 2 this control algorithm receives input from the fire control processor, weapon operator, inertial sensors, and relative position sensors located on the weapon cradle and sighting system. Using these inputs, the control algorithm causes the elevation means associated with the sighting system and weapon cradle axis to reposition as needed for accurate weapon firing.

FIG. 3 presents a further description of the elevation control algorithm indicating three modes of operation of the GWS; surveillance mode, fire control solution and tracking. Many possible control protocols can be predetermined and programmed into the central processor unit contained in the control unit. For example, in any of the three modes, the weapon cradle can remain stationary in elevation with the sighting system free to move in elevation while the operator acquires and tracks a target. Once a fire control solution has been determined by the fire control processor, the weapon cradle (and attached weapon) would be moved by its associated elevation means to the proper elevation needed to ensure the projectile hits the designated target. Alternatively, the control algorithm could cause the weapon cradle to continuously move in elevation in response to movement of the sighting system without first receiving input from the fire control processor. In this control protocol, the control algorithm would move the weapon cradle to a predetermined estimated offset elevation anticipating a final super-elevation position that will ultimately to be determined by the fire control processor. By continuously having the weapon cradle already offset by a predetermined estimated amount will result in less elevation distance travel for the weapon cradle once a final fire control solution is determined. In addition, this predetermined offset scheme will lead to a faster fire control solution.

Figure 4:
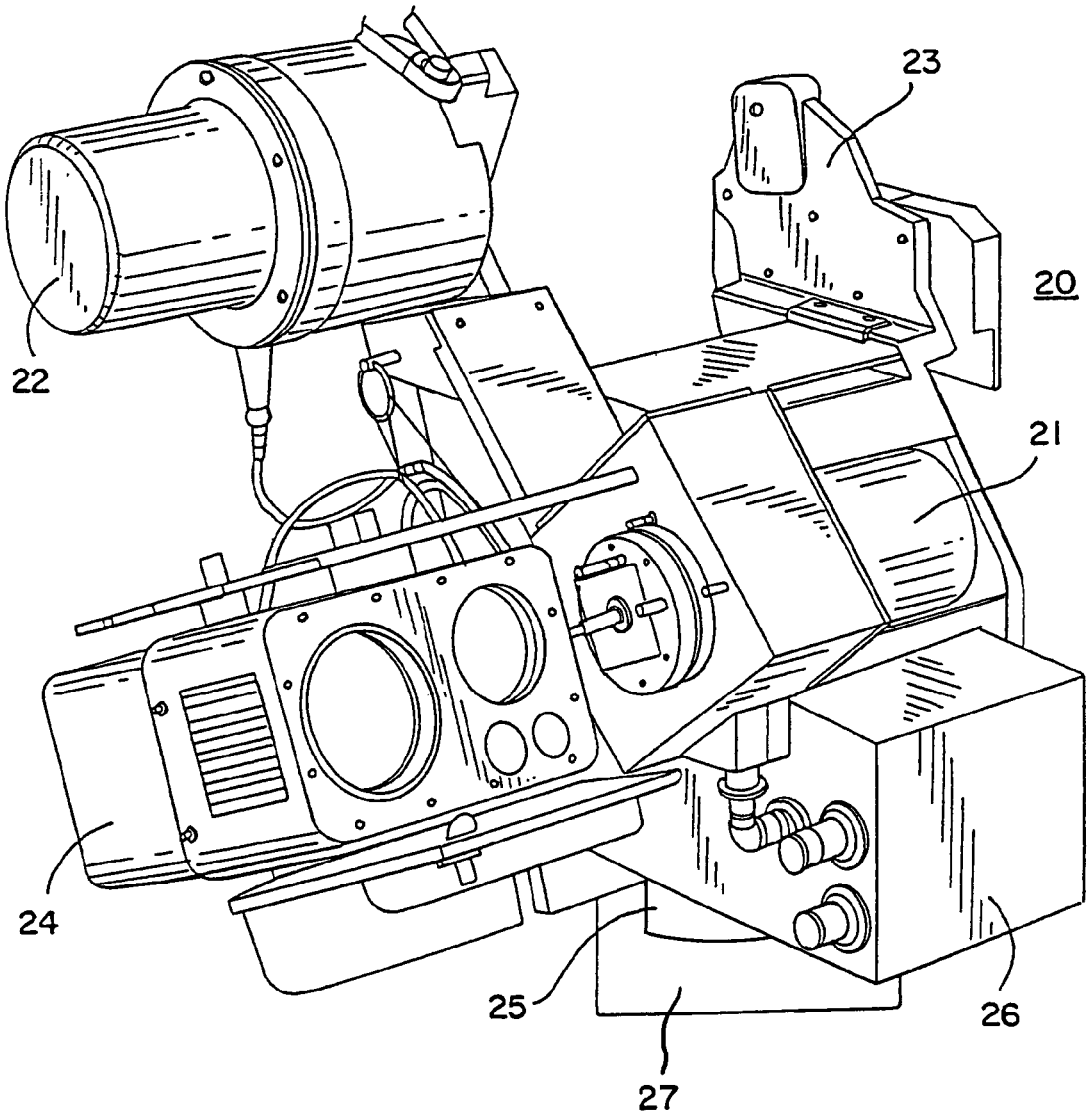
FIG. 4 is a perspective view of one embodiment of the GWS of my invention.

FIG. 4 illustrates one embodiment of the GWS of my invention where the operator interface and display (both not shown) are located remotely. GWS 20 has. azimuth drive means 25 positioned over platform mounting plate 27. Weapon cradle elevation means 22 is connected to weapon cradle 23 which is designed to accommodate a number of standard military issued weapons, including machine guns and grenade launchers, without requiring modification to the weapon. As mentioned, GWS 20 can also include a smart system which will detect the type of weapon mounted on weapon cradle 23 and will provide that information to control unit 26, which in turn uses that information to determine fire control solutions and provides feedback to the weapon operator. Optical sighting device 24 is moved in elevation by elevation means 21 independent of weapon cradle elevation means 22. Sighting device 24 can include a thermal imaging device and or a daylight imaging device to provide video for a real time on-screen display (not shown), both of which can be operated remotely from a user interface (not shown), such as with a joystick. The ability to magnify the video image is also desirable, with a preferred magnification in the range of about 0.5× through 8×. The video imaging devices could also be used to perform target tracking, which can be used to accurately determine a fire control solution. Also included on the sighting device would be a range determination means, preferably an active device, such as a laser range finder. Likewise, a passive device could also be used. The sighting device may also contain an acoustic device for target detection and/or a motion sensor to alert the operator of contact with a possible moving target.

Figure 5:
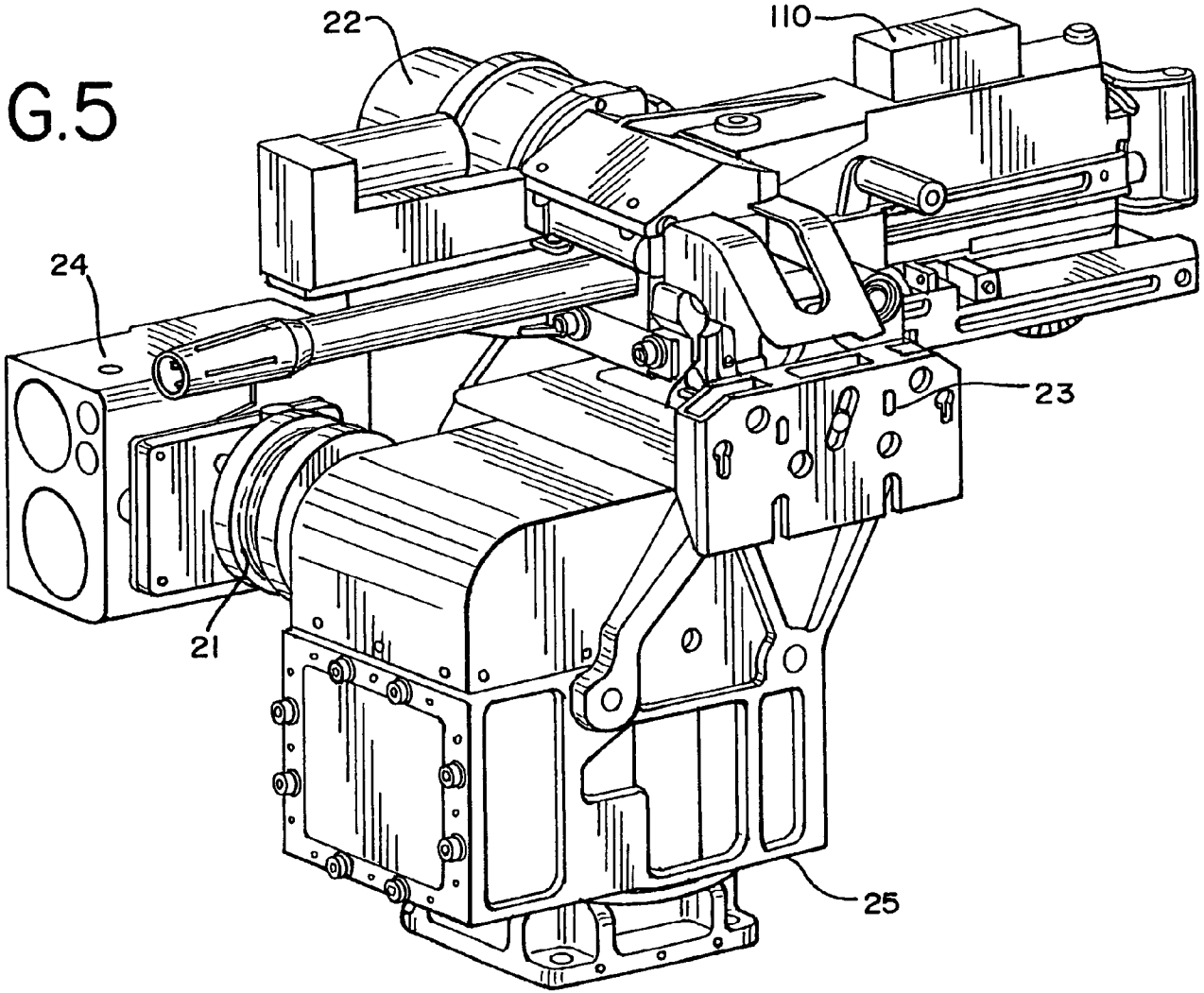
FIG. 5 is a perspective view of another embodiment of the GWS of my invention.

To allow for remote operation of the weapon cradle and sighting device the connection of control unit 26 to an operator interface and display is preferably accomplished with a single through-hull, quick-disconnect electrical connector. The quick-disconnect is preferred in situations when power loss may occur and manual operation of the GWS is then required. The GWS of my invention also allows for aligning the line-of-sight (LOS) of sighting device 24 with the bore of whatever weapon is mounted on the GWS. Both manual and electronic bore sighting is possible and follows well known and established protocols. FIG. 5 shows another embodiment of my invention with weapon 110 mounted in cradle 23, and sighting device 24 reoriented.

Figure 6:
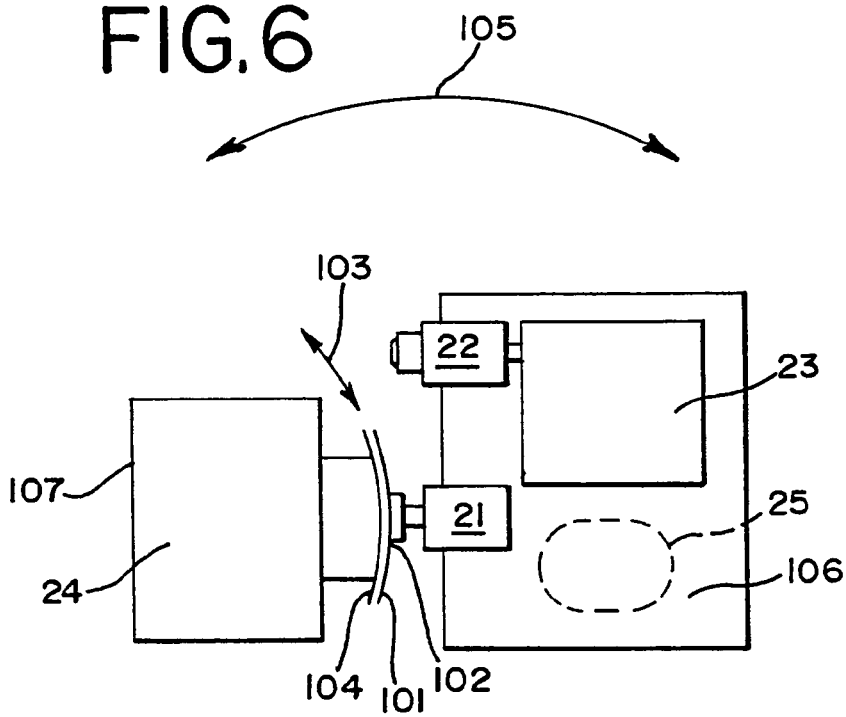
FIG. 6 is a top view of the GWS of my invention showing the sighting system in connection with a second azimuth drive means.
Figure 7:
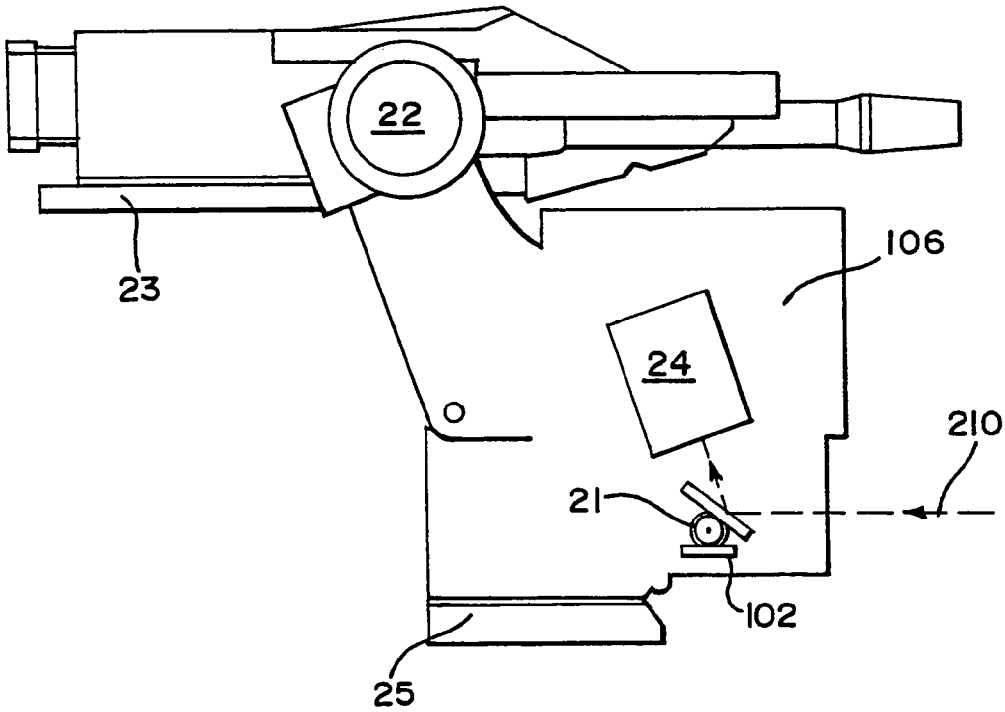
FIG. 7 is a side view of the GWS of my invention showing the LOS reflector and sighting device in connection with a second azimuth drive means.

The display/monitor used by the weapon operator can be a night and daylight readable active matrix liquid crystal display (LCD), either color or black and white. The display can also function as an operator command and control interface by providing a touch sensitive screen. It is preferred that the display and operator interface be located remotely from the sighting system and weapon cradle combination. In situations where the GWS is used on a moving vehicle, the display and operator interface are preferably located in the vehicle crew compartment. In addition to viewing the video output from the sighting device, the display also can include operator messages, target reticle and line of sight indication determined and generated by the control unit. Operator messages could include the identification of the weapon in the weapon cradle, GWS mode of operation (i.e., safe, fire, tracking, etc.), azimuth and elevation indication of the weapon, and ammunition type. As mentioned, my invention may also contain a second azimuth drive means in addition to the azimuth drive means which moves the entire GWS, i.e., gun mount and sighting system. A smaller, secondary azimuth drive means is necessary to keep the sighting system in LOS with the target in those situations where the control unit calculates a fire control situation that requires target lead, wind correction or other azimuth deviation from the LOS of the target. FIG. 6 shows one possible embodiment of my invention in a block sketch of the GWS view from above. Weapon cradle 23 is attached to the main body of 106 of the GWS Drive means 22 independently elevates weapon cradle 23 from drive means 21, which is used to elevate sighting system 107. A secondary azimuth drive means 102 is shown connected to the sighting system and allows the sighting system to move in an arcuate azimuth direction 103 about arcuate track 104. A worm gear or other drive mechanism is part of drive means 102 that allows track 104 to move in direction 103 about track 101 and opposite to direction 105 of primary azimuth drive means 25. Because secondary azimuth means 102 is connected to elevation means 21, the sighting system 107 and secondary azimuth means 102 can be elevated by drive means 21 independent of drive means 22. FIG. 6 shows the sighting system 107 comprising just the sighting device 24 as described above, however, a preferred alternate embodiment (see FIG. 7) includes sighting system 107 comprises sighting device 24 in combination with a LOS reflector 200, where LOS 200 reflector is mounted to secondary azimuth means 102 in place of sighting device 24. In such an embodiment sighting device 24 would be mounted in a fixed position on main body 106 where is would receive a reflected image of the target 210 from LOS reflector 200. This alternative allows sighting device 24 to be mounted in a fixed position and protected from damage or obstructed view due to environmental conditions (rain, dust, snow, etc.) or from enemy fire. In addition, because the sighting device 24 is much heavier than an LOS reflector, which in its basic form is a glass mirror or other optically reflective surface, the secondary drive means 102 and elevation means 21 are subjected to less stress, wear and tear, and both can be of a less massive design than needed to move sighting device 24. A variety of different designs exist for achieving the purposes of the LOS reflector of my invention, including designs disclosed in U.S. Pat. No. 6,123,006, which is incorporated herein by reference. Although the specific details of the LOS reflector are not critical to my invention, it is necessary that sighting device 24 is mounted to main body 106 such that a target image captured and reflected by the LOS reflector will be observed by the image detector contained in sighting device 24. Regardless of the design selected for the LOS reflector it is necessary that the LOS reflector itself or the control unit contain the appropriate devices or software to ensure that the image observed on the observation units is an accurate depiction of the actual spatial relationship of the target, i.e. what is observed as "right" is "right" and what is "up" is "up".

Figure 8:
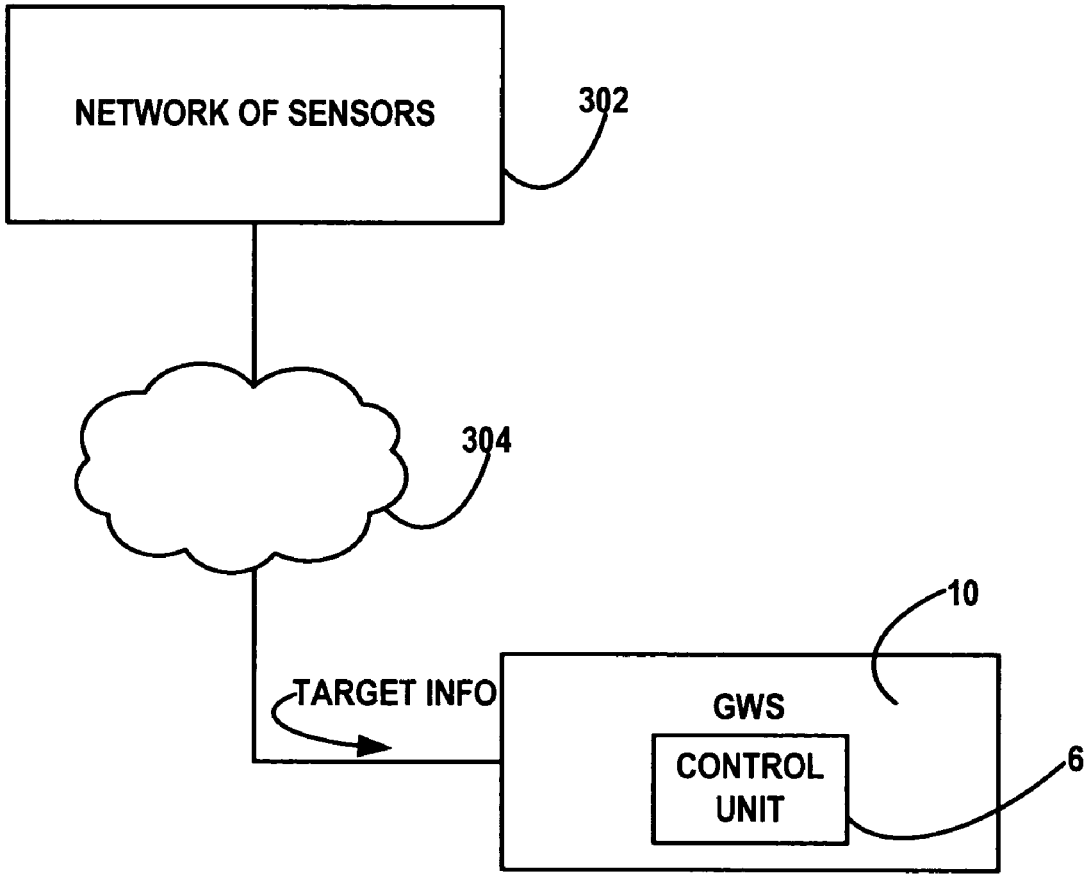
FIG. 8 is an illustration of an embodiment in which the GWS receives target location information from a network of sensors.

FIG. 8 illustrates a GWS 10 receiving target information from a network of sensors 302 via a network 304, which, as noted above may be a wired or wireless network.

While my invention has been described in it preferred embodiments, it is to be understood that the words which have been used are words of description, rather than limitation, and that changes may be made within the preview of the appended claims without departing from the true scope and spirit of the invention in its broader aspects.

I claim:

1. A method of observing a target during operation of a gimbaled weapon system (GWS) while maintaining a weapon associated with the GWS in a non-threatening position comprising the following steps, in combination:

a) providing a GWS having a sighting system, a weapon cradle, a control unit and said weapon, wherein the weapon cradle is elevated using a first elevation drive, and wherein the weapon cradle is co-located with the sighting system as a unit in the GWS;

b) executing an algorithm in the control unit which results in positioning the weapon in a non-hostile position using the first elevation drive; and c) moving the sighting system in elevation using a second elevation drive independent from the first elevation drive and acquiring a visual image of a target, the movement based on signals received from an operator interface located remotely from the GWS, the movement of the sighting system and acquiring the visual image of the target occurring while the weapon is maintained in the non-hostile position.

2. The method of claim 1, wherein the non-hostile position comprises a stowed position.

3. The method of claim 1, further comprising the step of determining a fire control solution for the hitting the target with the weapon.

4. The method of claim 1, further comprising the step of recording the target acquired by the sighting system while the weapon is maintained in the non-hostile position.

5. A method of operating a gimbaled weapon system (GWS) using input from a network of sensors, comprising the following steps in combination:

a) providing a GWS having a sighting system, a control unit, a weapon cradle and an operator interface for the GWS located remotely from the GWS, wherein the weapon cradle is elevated using a first elevation drive;

b) utilizing a network of sensors in communication with the control unit; and c) elevating the sighting system using a second elevation drive to acquire a target based on signals received the network of sensors, wherein the network of sensors determines coordinates for the target and wherein the method further comprises the step of transmitting the coordinates to the control unit of the GWS;

and wherein the method further comprises the steps of moving the weapon cradle to an aim point based on the coordinates of the target, determining the elevation of the sighting system with a first position sensor, determining the position of the weapon cradle with a second position sensor, and calculating an offset elevation for the weapon cradle using the control unit.

6. The method of claim 5, wherein the network of sensors include sensors hosted by at least one of satellites, manned aircraft, unmanned aerial vehicles, ground vehicles, and other GWSs.

7. The method of claim 5, wherein the sensors comprise at least one acoustic sensor.

8. The method of claim 7, wherein the sensors comprise a plurality of acoustic sensors, wherein the acoustic sensors provide target coordinates to the GWS, and wherein the sighting system points to the target coordinates in response to receiving the target coordinates from the acoustic sensors.

9. The method of claim 5, wherein the sensors comprise sensors selected from the group of sensors consisting of radar, infrared sensors, and acoustic sensors.

* * * * *